US007840160B2

(12) United States Patent
Shimomura

(10) Patent No.: US 7,840,160 B2
(45) Date of Patent: Nov. 23, 2010

(54) TONER CARTRIDGE WITH MEMORY ELEMENT, IMAGE DRUM UNIT WITH THE TONER CARTRIDGE, AND IMAGE FORMING APPARATUS WITH THE IMAGE DRUM UNIT

(75) Inventor: Tatsuhiko Shimomura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/693,815

(22) Filed: Mar. 30, 2007

(65) Prior Publication Data

US 2007/0230999 A1 Oct. 4, 2007

(30) Foreign Application Priority Data

Mar. 31, 2006 (JP) ..... 2006-097147

(51) Int. Cl.
*G03G 15/04* (2006.01)

(52) U.S. Cl. ..... 399/119

(58) Field of Classification Search ..... 399/113, 399/262, 114, 120, 232, 258, 111, 119
See application file for complete search history.

(56) References Cited

U.S. PATENT DOCUMENTS 4,961,088 A * 10/1990 Gilliland et al. ..... 399/25
6,134,410 A * 10/2000 Nakajima ..... 399/262
2002/0021909 A1* 2/2002 Harumoto ..... 399/27
2002/0044795 A1* 4/2002 Kato ..... 399/262
2006/0083555 A1* 4/2006 Uchiyama et al. ..... 399/258

FOREIGN PATENT DOCUMENTS

EP 0395320 A1 10/1990
JP 06149051 A 5/1994
JP 2002-169365 * 6/2002
JP 2002-169365 A 6/2002

* cited by examiner

*Primary Examiner*—David M Gray
*Assistant Examiner*—Billy J Lactaoen
(74) *Attorney, Agent, or Firm*—Panitch Schwarze Belisario & Nadel LLP

(57) ABSTRACT

A toner cartridge extends in a longitudinal direction, and is detachably attached to an image drum unit. A memory element is electrically connected to an electrical terminal. The toner cartridge includes a first end portion on which the electrical terminal is disposed and a second end portion longitudinally opposite to the first end portion. An engagement portion is formed on the outer surface of the toner cartridge in the vicinity of the first end portion. When the toner cartridge is attached into the image drum unit, the second end portion engages the image drum unit, and the engagement portion engages the image drum unit such that the toner cartridge is urged against the image drum unit.

20 Claims, 19 Drawing Sheets

TONER CARTRIDGE WITH MEMORY ELEMENT, IMAGE DRUM UNIT WITH THE TONER CARTRIDGE, AND IMAGE FORMING APPARATUS WITH THE IMAGE DRUM UNIT

BACKGROUND OF THE INVENTION

1. Field of the Invention

The present invention relates to a toner cartridge, for use in an image forming apparatus that forms an electrostatic latent image and develops the electrostatic static latent image into a visible image, an image drum unit (ID unit) to which the toner cartridge is detachably mounted, and an image forming apparatus.

2. Description of the Related Art

An electrostatic latent image is formed on a photoconductive drum, and is developed in an ID unit into a toner image. Electrophotographic printers such as LED printers frequently make use of a replaceable consumable which is in the form of a toner cartridge.

A toner cartridge is formed with a discharge opening through which toner is discharged. The toner cartridge is attached to the ID unit such that the discharge opening is in alignment with a receiving opening formed in the ID unit. Then, a shutter or a seal of the toner cartridge is opened, the toner is discharged from the discharge opening into the ID unit. The properties of toner determine the design factors such as toner type; the specifications of rollers and a member for controlling a thickness of a toner layer; printing speeds; the conditions for applying high voltages; and the temperature settings of a fixing unit may be dependent. Therefore, if toner not designed for use in the ID unit is replenished, printing results is poor, or jamming of paper occurs due to the fact that non-fused toner adhering to a fixing roller.

In order to prevent the aforementioned drawbacks, a toner cartridge may be equipped with a memory element that holds information on the toner held in the toner cartridge. When the toner cartridge is attached to the ID unit, the information on the toner may be read into an image forming apparatus. When a toner cartridge holding an unacceptable toner is mounted to the ID unit, a warning or message may be displayed to a user on a liquid crystal display (LCD). Data communication between the memory element and the image forming apparatus is of two types: a contact type and a non-contact type. For the contact type, a proper pressure between a contact area of the memory element and a contact area of the image forming apparatus may not be ensured due to dimensional errors within tolerances, preventing good electrical connection from being made. Japanese Patent Application Laid-Open No. 2002-169365 discloses a structure for solving such a problem. That is, contact areas are provided at locations of the image forming apparatus where the toner cartridge is pressed against the ID unit. The contact areas make electrical continuity.

When the toner cartridge is mounted to the ID unit, the toner cartridge should be pressed against the ID unit with a force more than necessary for making electrical connection. This relatively large force may cause scratches and/or damage to the contacts when the toner cartridge is mounted or dismounted. Scratches and damage prevents the toner cartridge from being recycled.

SUMMARY OF THE INVENTION

An object of the invention is to provide a toner cartridge that includes a memory element and contacts electrically connected to the memory element, electrical connection being made with an ID unit or an image forming apparatus through the contacts.

Another object of the invention is to provide a toner cartridge and an ID unit in which damage to the contacts of the toner cartridge and poor electrical contact between the toner cartridge and the developing may be eliminated such that the toner cartridge can be recycled.

A toner cartridge extends in a longitudinal direction, and is detachably attached to an image drum unit. A memory element is electrically connected to an electrical terminal. The toner cartridge includes a first end portion on which the electrical terminal is disposed and a second end portion longitudinally opposite to the first end portion. An engagement portion is formed in the vicinity of the first end portion. When the toner cartridge is attached into the image drum unit, the second end portion engages the image drum unit, and the engagement portion engages the image drum unit such that the toner cartridge is pressed against the image drum unit.

The toner cartridge extends in a longitudinal direction, and includes the first end portion and the second end portion at longitudinal end portions of the toner cartridge, wherein the engagement portion is formed on an outer surface of the toner cartridge.

The toner cartridge includes a lid fitted to the first end portion of the toner cartridge with a resilient member sandwiched between the lid and the first end portion.

The resilient member seals a gap between the lid and the first end portion.

The toner cartridge includes a circuit board on which the memory element and the first electrical terminal are mounted, the circuit board being removably attached to the first end portion.

An image drum unit receives the aforementioned toner cartridge detachably attached. The image drum unit includes a second electrical terminal and a receiving member. The second electrical terminal electrically connected to the first electrical terminal when the toner cartridge is attached into the image drum unit, information being communicated through the first and second electrical terminals between the memory element and the image drum unit. The receiving member that receives the engagement portion of the toner cartridge when the toner cartridge is attached into the image drum unit, the receiving member engages the engagement portion such that the toner cartridge is pressed against the image drum unit.

The receiving member includes a guide surface that guides the engagement portion toward second electrical terminal.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described with reference to the accompanying drawings.

First Embodiment

Figure 1:
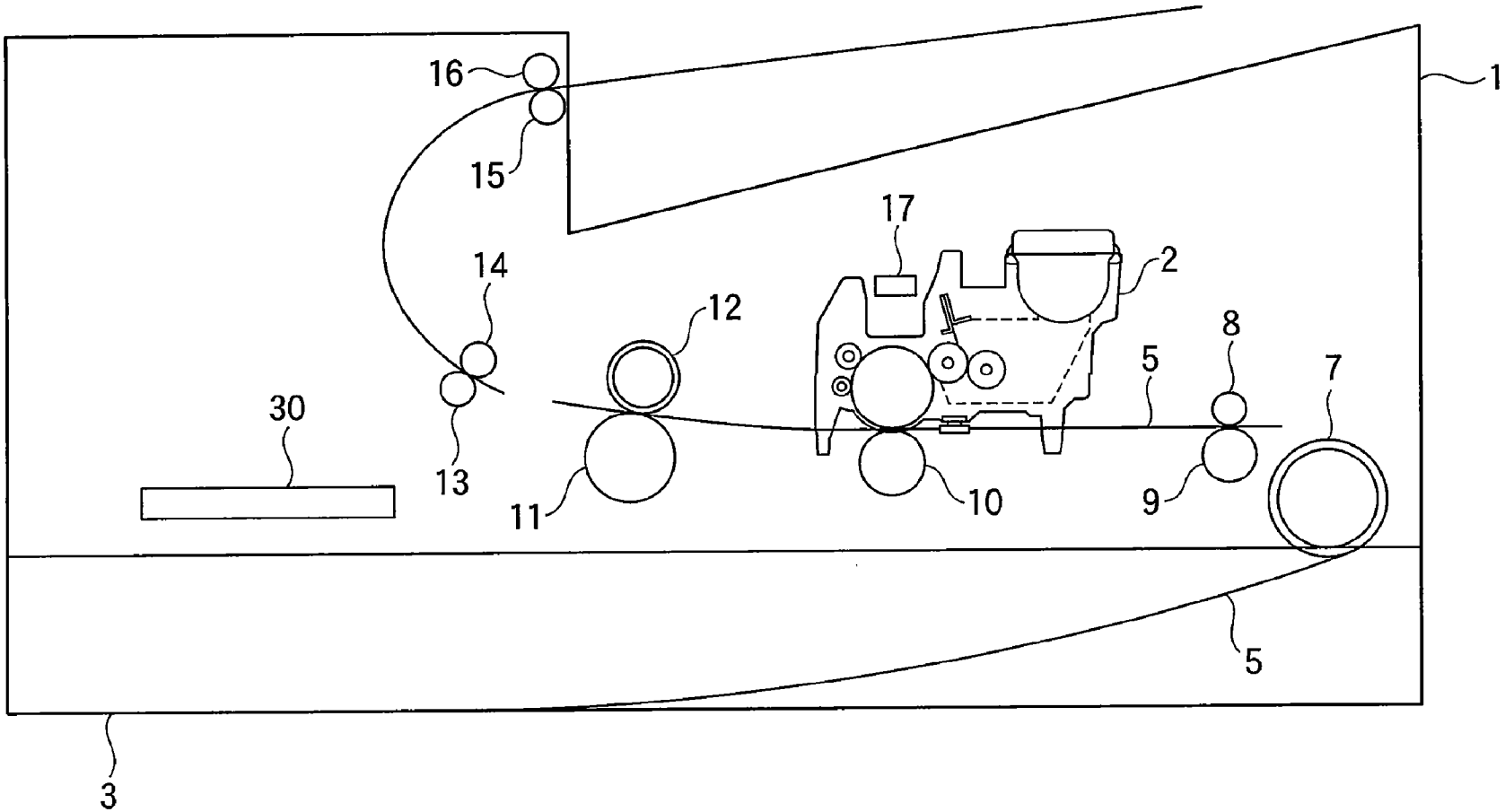
FIG. 1 illustrates an overall configuration of an image forming apparatus according to the invention.
Figure 2:
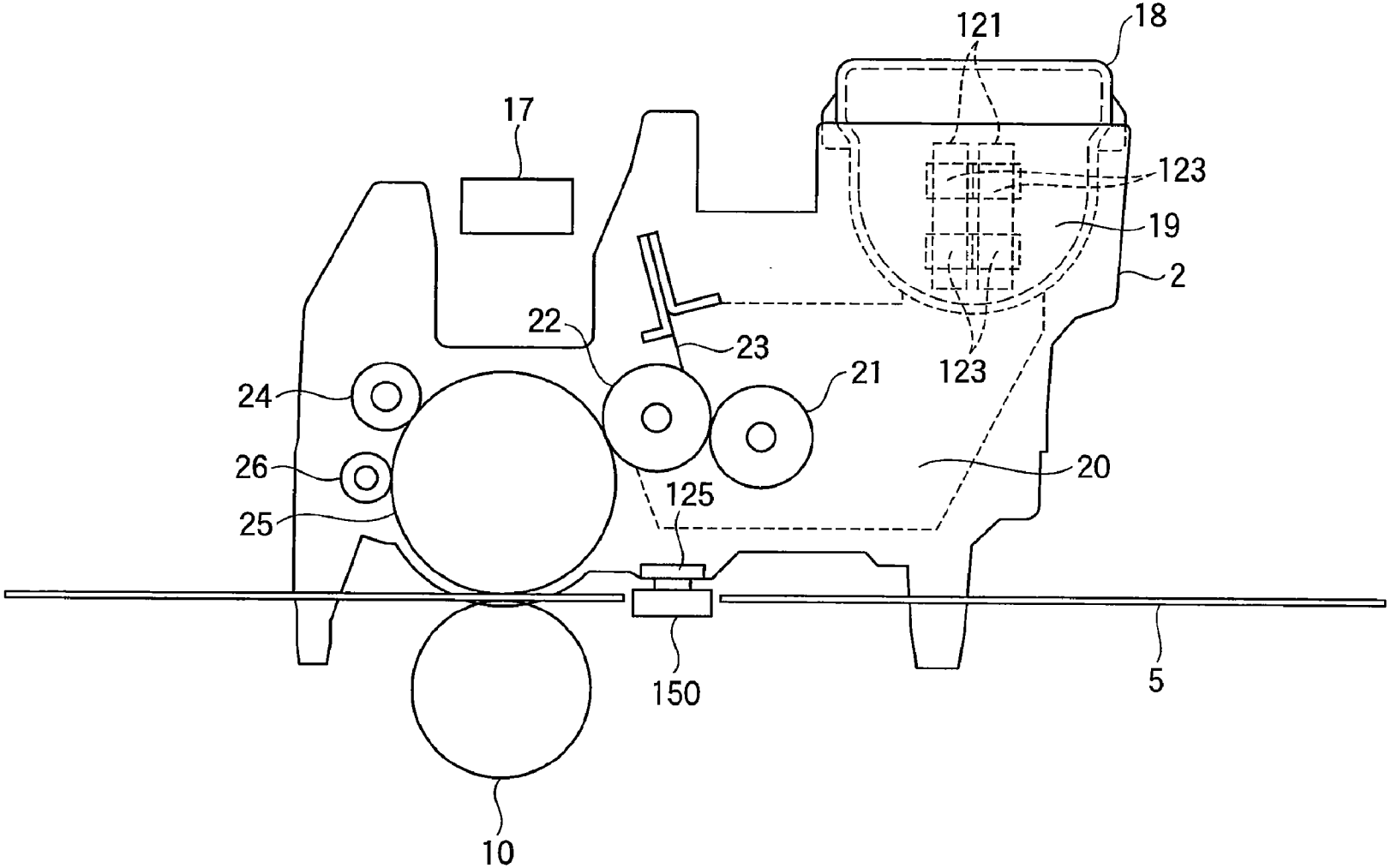
FIG. 2 is an enlarged view illustrating an ID unit.

FIG. 1 illustrates an overall configuration of an image forming apparatus according to the invention. FIG. 2 is an enlarged view illustrating an image drum unit (ID unit) 2.

Referring to FIGS. 1 and 2, a toner cartridge 18 includes a toner chamber 19 that holds toner. After the toner cartridge 18 has been attached to the ID unit 2, a shutter may be opened by operating a lever, so that the toner is discharged from the toner cartridge into a toner reservoir 20 of the ID unit 2. A toner supplying roller 21 supplies the toner to a developing roller 22. A blade 23 forms a thin layer of toner on the developing roller 22.

A charging roller 24 charges the surface of a photoconductive drum 25 uniformly. An exposing unit 17 selectively illuminates the charged surface of the photoconductive drum 25 to form an electrostatic latent image. The developing roller 22 develops the electrostatic latent image with toner into a toner image. A hopping roller 7 feeds a recording medium 5 from a cassette 3 into a transport path. The recording medium 5 is transported to registration rollers 8 and 9, which in turn feed the recording medium 5 into the ID unit 2 in timed relation with image formation in the ID unit 2. As the recording medium 5 passes through a transfer point defined between the photoconductive drum 25 and a transfer roller 10, the toner image is transferred from the photoconductive drum 25 onto the recording medium 5.

A cleaning roller 26 removes the toner remaining on the photoconductive drum 25 after transfer of the toner image. A fixing unit includes a heat roller 12 and a backup roller 11. The recording medium 5 passes through a fixing point defined between the heat roller 12 and the backup roller 11, so that the toner image is fused into a permanent image. The recording medium 5 is then discharged by discharge rollers 13-16. A controller 30 controls each printing operation. The cassette 3 holds a stack of recording medium 5.

A substantially cylindrical toner cartridge 18 includes contact pads 121*a* and 121*b* attached to a longitudinal end surface of the toner cartridge, the contact pads 121*a* and 121*b* being connected to a memory element 120 which will be described later. The ID unit 2 includes a connector 123. Information is communicated between the ID unit 2 and the toner cartridge 18 through the contact pads 121*a* and 121*b* and the connector 123. The connector 123 is connected to contacts 125*a* and 125*b* through wires and printed circuit board (not shown). A connector 150 is mounted on the image forming apparatus at a location where the connector 150 faces the contacts 125*a* and 125*b* on the ID unit 2. Thus, the information from the toner cartridge 18 is sent to the controller 30 of the image forming apparatus over wires (not shown).

Figure 3:
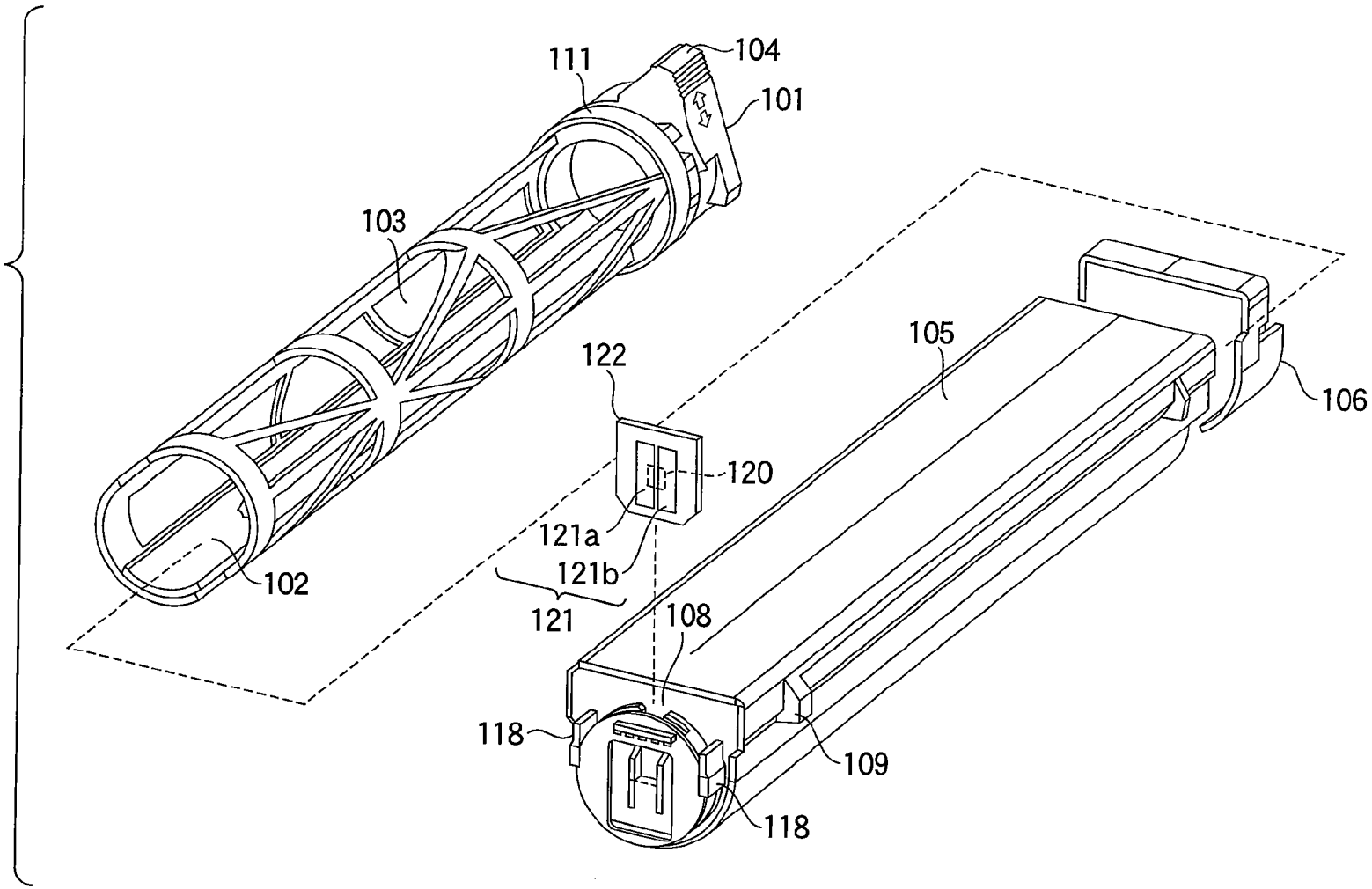
FIG. 3 is an exploded perspective view of the toner cartridge.
Figure 4:
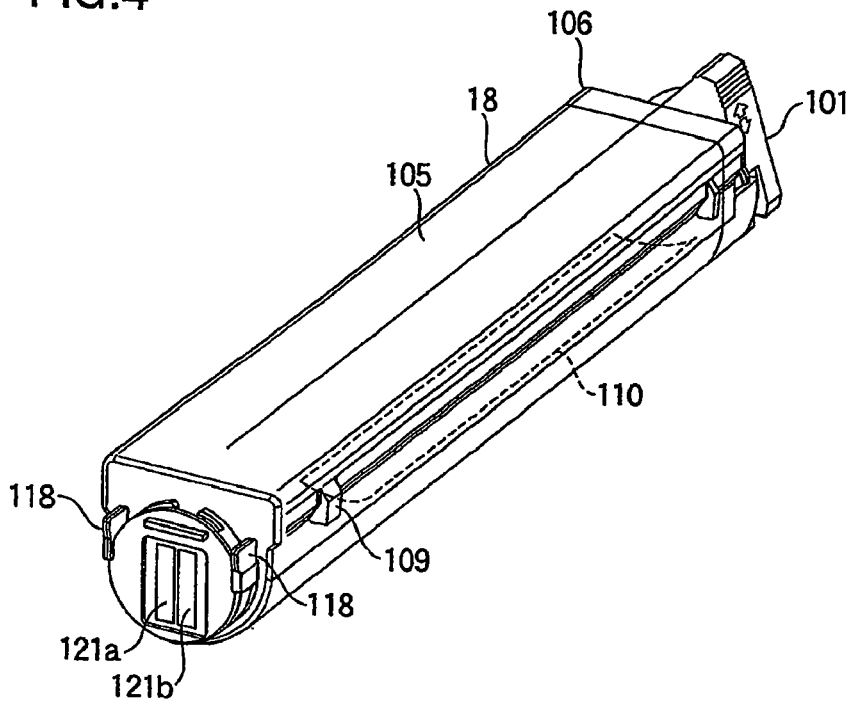
FIG. 4 is a perspective view of the toner cartridge after it is assembled into an integral unit.

FIG. 3 is an exploded perspective view of the toner cartridge 18. FIG. 4 is a perspective view of the toner cartridge 18 when the toner cartridge 18 has been assembled into an integral unit.

The toner cartridge 18 includes an inner cylinder 101 and an outer cylinder 105 in which the inner cylinder 101 is inserted. The inner cylinder 101 serves as a shutter that controls supply of toner. The outer cylinder 105 receives the inner cylinder 101 in it. The inner cylinder 101 and outer cylinder 105 are formed of a thermal plastic resin material such as acrylonitrile-butadiene stylen resin (ABS). The inner cylinder 101 includes a shutter 102 that has a curved surface and prevents the toner from leaking, an opening 103, a lever 104 that causes the inner cylinder 101 to rotate, and a sealing member 111 that prevents the toner from leaking through a gap between the inner cylinder 101 and the outer cylinder 105. A sealing member (not shown) is provided on the inner surface of the shutter 102, facing the opening 103 formed in the outer cylinder 101.

A memory element 120 and a pocket 108 are provided at a longitudinal end surface of the outer cylinder 105. The memory element 120 stores the information on the toner. The pocket 108 receives a circuit board 122 having the contact pads 121*a* and 121*b* which are electrically connected to the memory element 120. A side lid 106 is attached by, for example, adhesion on a longitudinal end surface of the outer cylinder 105. Projections 109 are formed in one piece with an outer cylinder 105 and are located on the outer surface of the outer cylinder 105 in the vicinity of the longitudinal end. When the toner cartridge 18 is attached to the ID unit 2, the projections 109 engage corresponding receiving portions 119 (FIG. 8) of the ID unit 2. Alternatively, the projections 109 may be formed as a member separate from the outer cylinder 105, and then the projections 109 may be mounted to the outer cylinder 105.

Projections 118 are formed on the toner cartridge 18. When the toner cartridge is attached to the ID unit 2, the projections 118 engage projections 117 (FIG. 8) of the ID unit 2.

Figure 5A:
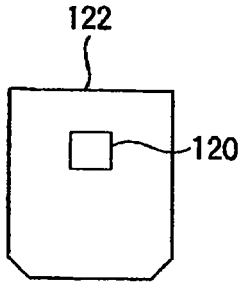
FIGS. 5A-5C illustrate the circuit board.
Figure 5B:
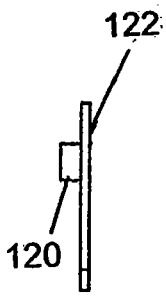
Figure 5C:
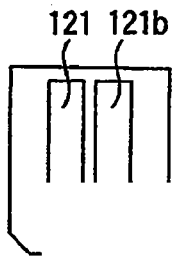

FIGS. 5-7 illustrate a circuit board 122 in detail. FIGS. 5A-5C illustrate the circuit board 122. The circuit board 122 is substantially in the shape of a rectangle with two corners chopped off. The memory element 120 is mounted on the back surface of the circuit board 122. The contact pads 121*a* and 121*b* are formed on the opposite surface of the circuit board 122, and are electrically connected to the memory element 120 via through-holes.

Figure 6A:
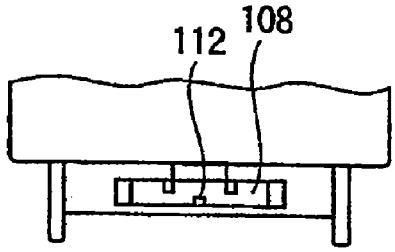
FIGS. 6A-6C illustrate the longitudinal end of the toner cartridge before insertion of the circuit board.
Figure 6B:
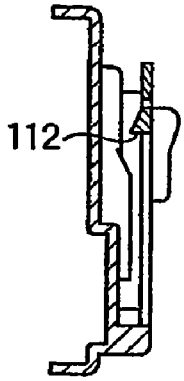
Figure 6C:
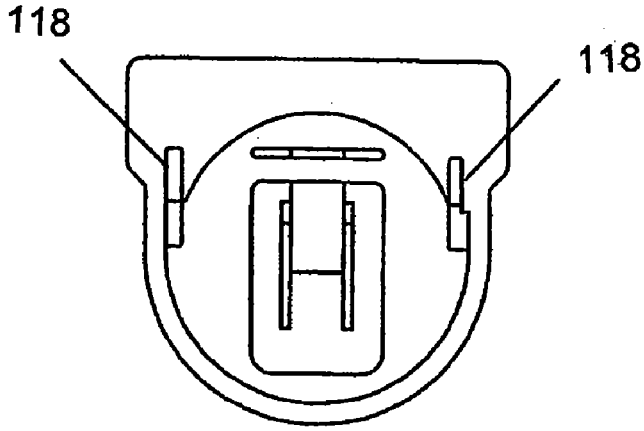
Figure 7B:
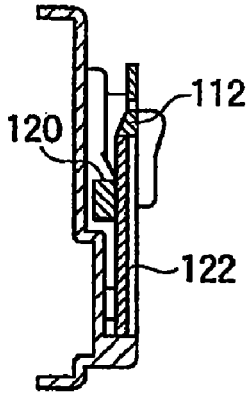
FIGS. 7A and 7B illustrate the longitudinal end of the toner cartridge after insertion of the circuit board.
Figure 7A:
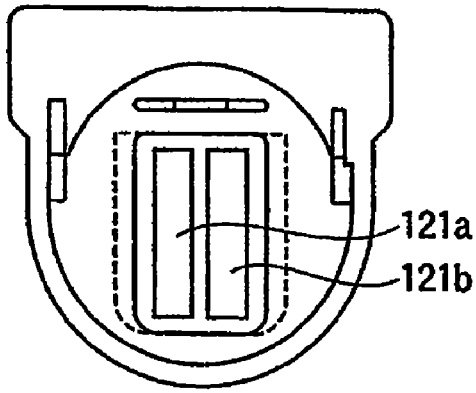

FIGS. 6A-6C illustrate the longitudinal end portion of the toner cartridge before the circuit board 122 is mounted to the toner cartridge. FIG. 6B is a left cross-sectional view. FIG. 6C is a front view. FIGS. 7A and 7B illustrate the longitudinal end of the toner cartridge after the circuit board 122 has been mounted. FIG. 7B is a left cross-sectional view. The circuit board 122 is inserted into the pocket 108 with the contact pads 121*a* and 121*b* facing outward. As the circuit board 122 enters the pocket 108, the circuit board 122 pushes the projection 112 to resiliently deform until the circuit board 122 reaches a predetermined position. Then, the projection 112 returns to its original position, firmly holding the circuit board 122. In this manner, the circuit board 122 is firmly received in the pocket 108.

Figure 8:
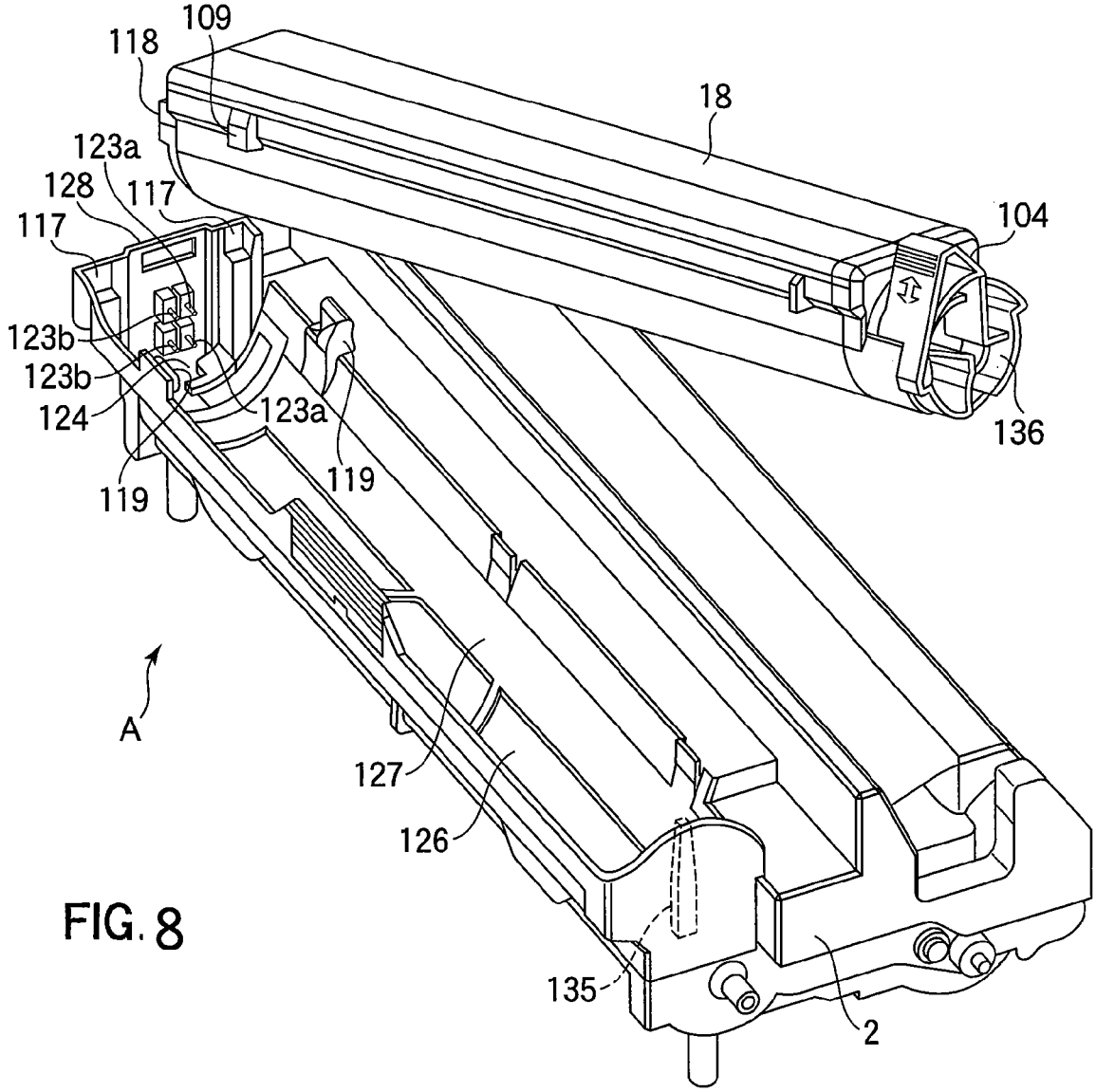
FIG. 8 is a perspective view illustrating the ID unit to which the toner cartridge is mounted.
Figure 9:
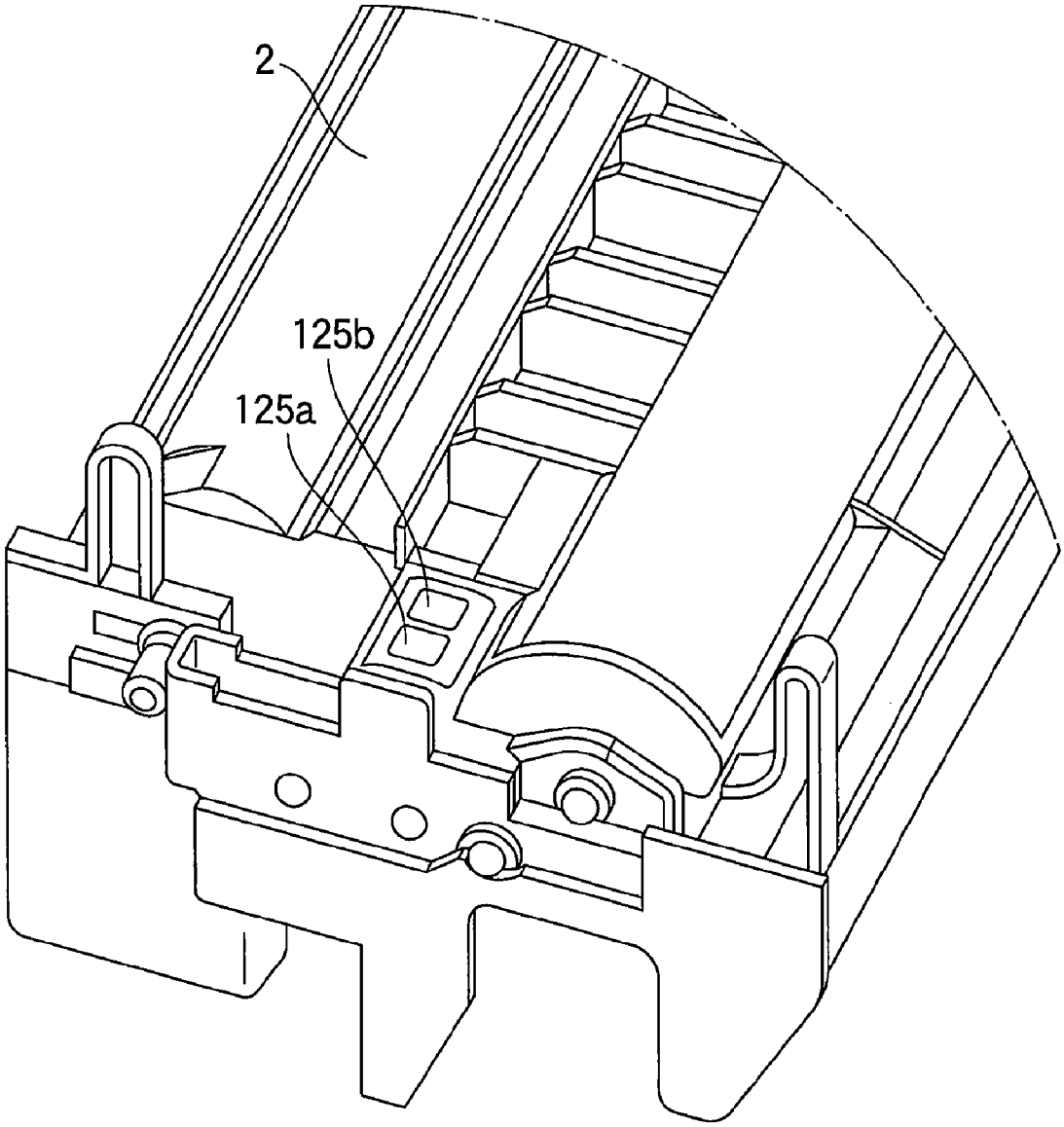
FIG. 9 is a partial perspective view of a rear side of the ID unit as seen in a direction shown by arrow A in FIG. 8.

FIG. 8 is a perspective view illustrating the ID unit 2 to which the toner cartridge 18 is to be mounted. FIG. 9 is a partial perspective view of a rear side of the ID unit 2 as seen in a direction shown by arrow A in FIG. 8. FIG. 8 illustrates the toner cartridge 18 before it is attached to the ID unit. The ID unit 2 includes the connector 123 that makes electrical connection with the contact pads 121*a* and 121*b* on the cartridge side. The connector 123 includes two connector pins 123*a* that contact the contact pad 121*a* and two connector pins 123*b* that contact the contact pad 121*b*. Two connector pins are used for one contact pad to ensure reliable electrical connection of the contact pads 121*a* and 121*b* with the connector 123.

The connector 123 is connected, through a circuit board 124 and wires (not shown), to the contacts 125*a* and 125*b* provided on the ID unit 2 (FIG. 9) for electrical connection with the image forming apparatus. The circuit board 122 with the connector 123 mounted on it is supported by a wall 128 that is normal to a direction in which the connector 123 is pressed. Referring to FIG. 8, a sealing member 127 is attached to surround a toner receiving opening 126, thereby preventing the toner from leaking through the gap between the developing unit 2 and the outer wall of the toner cartridge defining a toner discharging opening 110. When the toner cartridge 18 is attached to the ID unit 2, the projections 118 of the toner cartridge 18 engage the projections 117 to prevent uplift of the toner cartridge 18. The receiving portions 119 of the ID unit 2 engage the projections 109 of the toner cartridge 18, thereby causing the projections 109 to be pressed toward the connector 123 so that the contact pads 121*a* and 121*b* on the toner cartridge 18 side move into electrical contact with the connector pins 123*a* and 123*b* of the connector 123 of the ID unit 2 under a predetermined urging force provided by the resiliency of the connector pins 123*a* and 123*b*.

Figure 10A:
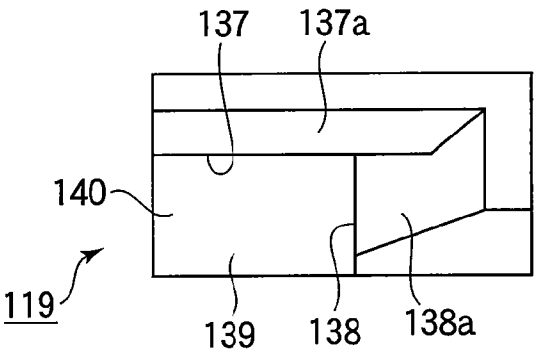
FIGS. 10A-10D illustrate a receiving portion.
Figure 10B:
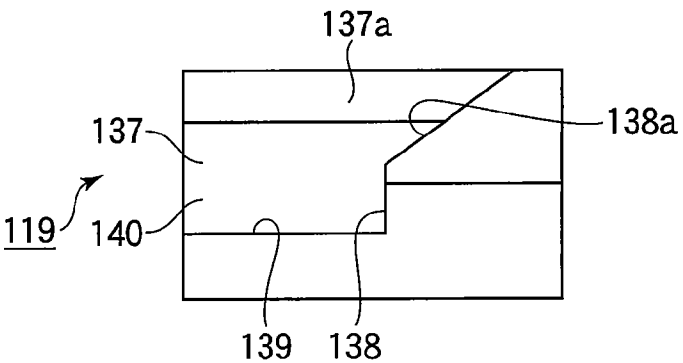
Figure 10D:
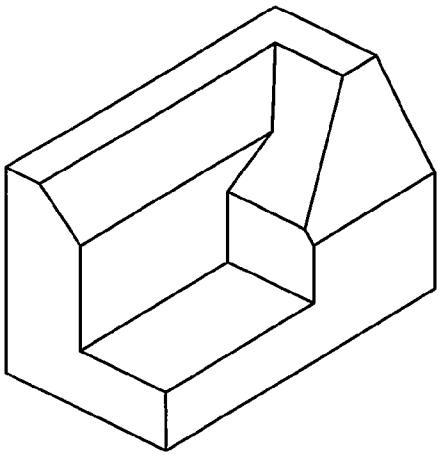
Figure 10C:
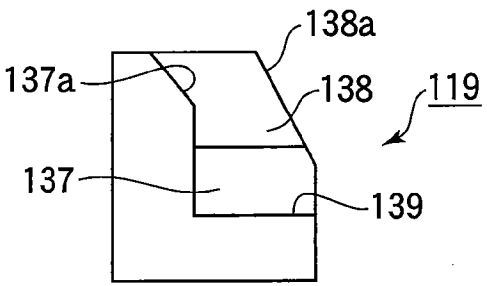

FIGS. 10A to 10D illustrate the receiving portion 119. FIG. 10A is a top view. FIG. 10B is a front view. FIG. 10C is a left side view. FIG. 10D is a perspective view of the receiving portion 119. The receiving portions 119 receive projections 109 that project from the outer surface of the toner cartridge 18. Referring to FIGS. 10A-10C, the receiving portion 119 includes a wall 137, a wall 138, and a bottom 139. The wall 137 restricts and guides the widthwise movement of the toner cartridge 18. The wall 138 restricts and guides the longitudinal movement of the toner cartridge 18. The walls 137 and 138 have inclined surfaces 137*a* and 138*a* that guide the projection 109 into a groove 140 defined by the walls 137 and 138 and the bottom 139.

Figure 11:
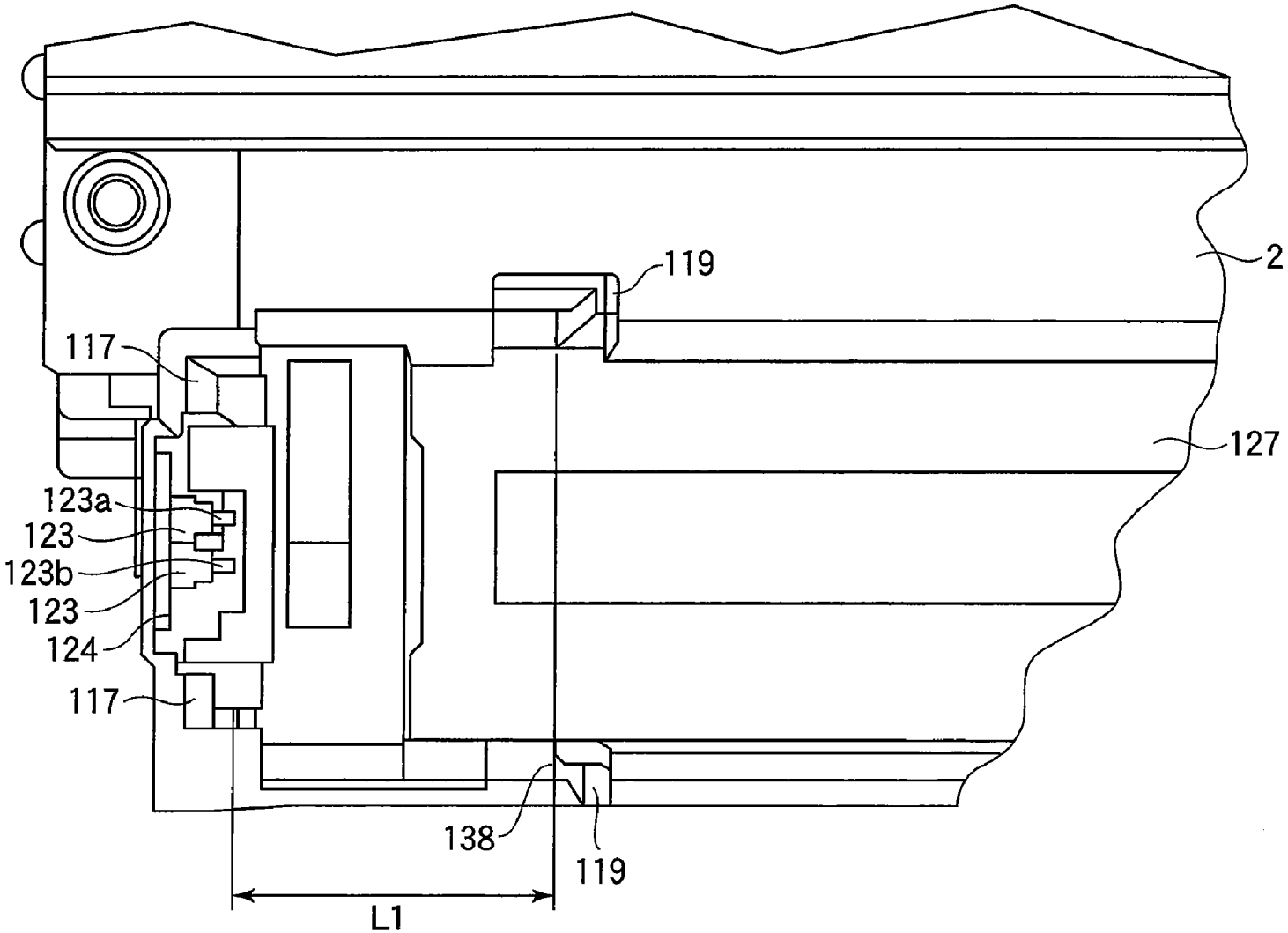
FIG. 11 is a top view illustrating an engageable portion before the toner cartridge is attached to the ID unit.

FIG. 11 is a top view illustrating an engageable portion before the toner cartridge 18 has been attached to the ID unit 2.

Figure 12:
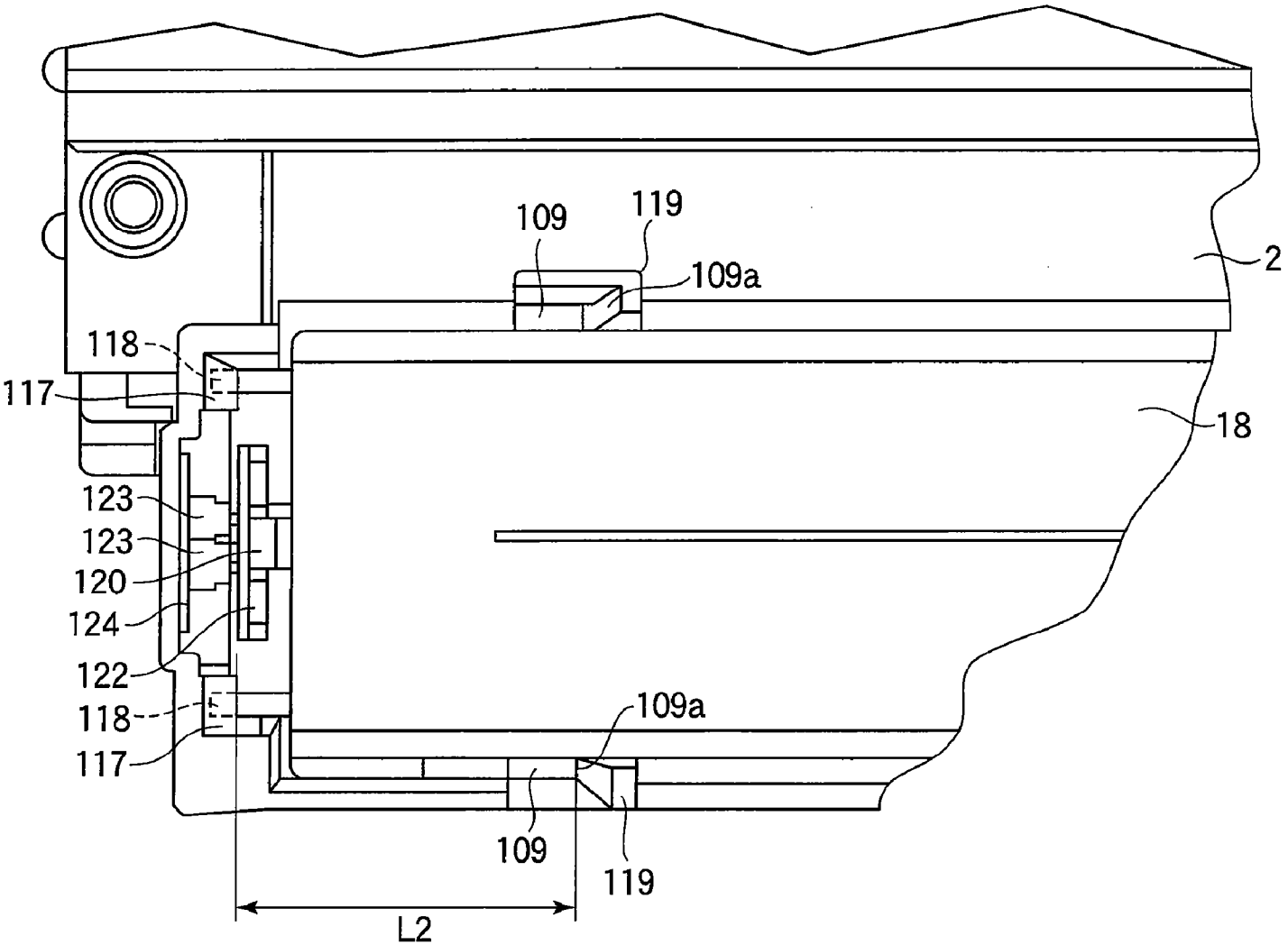
FIG. 12 is a top view illustrating an engaged portion after the toner cartridge is attached to the ID unit.

FIG. 12 is a top view illustrating an engaged portion after the toner cartridge 18 has been attached to the ID unit 2.

Figure 15:
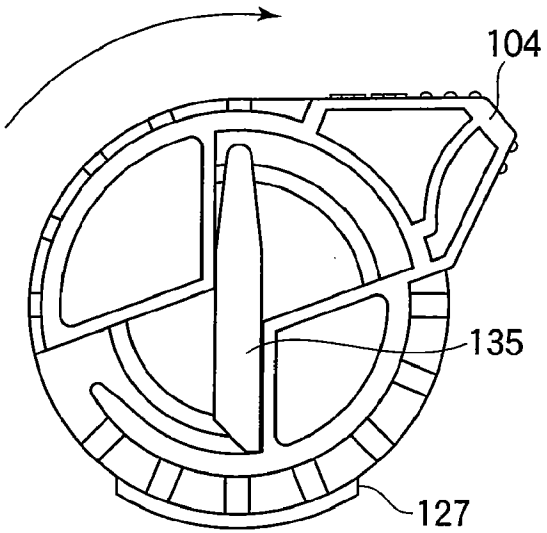
FIGS. 13-15 illustrate the positional relation between a lever and a projection of the ID unit.
Figure 14:
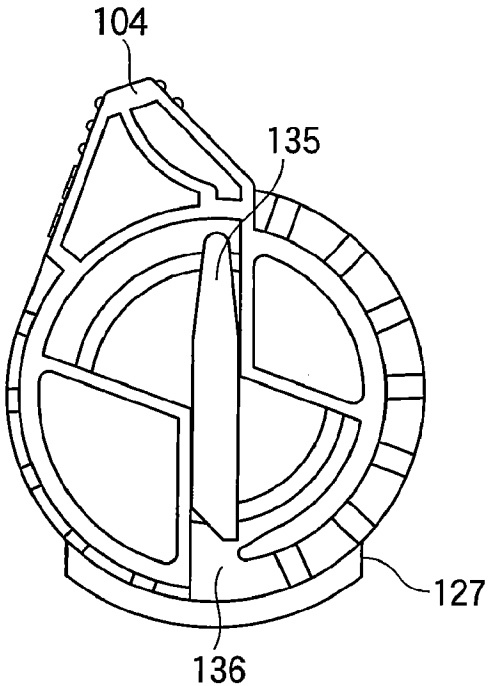
Figure 13:
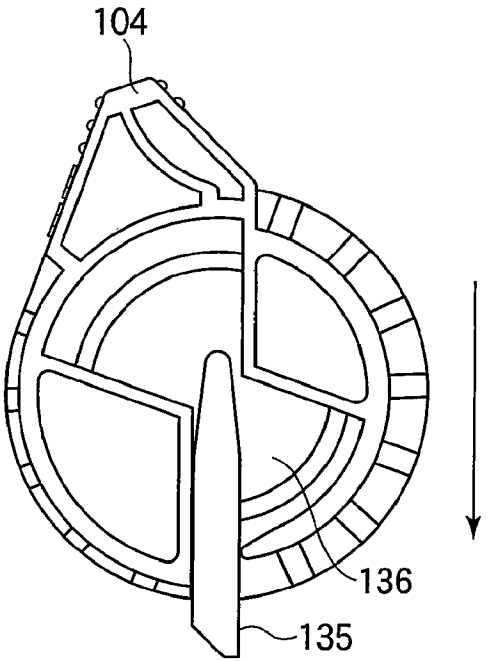

FIGS. 13-15 illustrate the positional relation between a lever 104 of the toner cartridge and a projection 135 of the ID unit 2.

The toner cartridge 18 is inserted into the ID unit 2 from above pushing the connector 123 obliquely in such a way that the projections 118 of the toner cartridge 18 fit the projections 117 of the ID unit 2 and the projections 109 of the toner cartridge 18 fit the receiving portions 119 of the ID unit 2. The inclined surfaces 137*a* and 138*a* guide the projection 109 into the groove 140 to ensure that the projection 109 is placed in position at the bottom of the receiving portion 119. A projection 135 of the ID unit 2 fits into a groove 136 formed in the lever 104 of the toner cartridge 18 in FIGS. 8 and 13-15. Then, rotating the lever 104 causes the toner cartridge 18 to be attached into the ID unit 2, while also compressing the sealing member 127. The sealing member 127 is formed of a sponge material such as foamed urethane, and is glued to the ID unit 2 to surround the toner receiving opening 126. The sealing member 127 is compressed and the toner cartridge 18 is pressed, so that the toner leakage in the vicinity of the toner receiving opening 126 of the ID unit 2.

A distance L1 (FIG. 11) is a distance between a wall surface 138 of the receiving portion 119 of the ID unit 2 and the tip of the connector pins 123*a* and 123*b*. A distance L2 (FIG. 12) is a distance between an engagement surface 109*a* of the projection 109 of the toner cartridge 18 and the contact pads 121*a* and 121*b*. The distance L2 is longer than the distance L1, so that when the connector 121 pushes the connector pins 123*a* and 123*b*, the connector pins 123*a* and 123*b* are deformed by the difference between the distances L1 and L2. The term "effective stroke" is used to cover the range of deformation of the connector pins 123*a* and 123*b*. A minimum required amount of deformation is an amount of deformation of the connector pins 123*a* and 123*b* required for ensuring desired electrical continuity between the contact 121 and the connector 123. A maximum allowable amount of deformation is an amount of deformation of the connector pins 123*a* and 123*b* just before the connector pins 123*a* and 123*b* are permanently deformed. The effective stroke of the connector pins 123*a* and 123*b* is the range from the minimum required amount of deformation to the maximum allowable amount of deformation. For example, if the effective stroke is selected to be in the range of 0.5 to 1.5 mm, the difference between the distance L1 and L2 should be 1 mm, a cumulative tolerance of structural components should be in the range of ±0.5 mm.

Figure 16A:
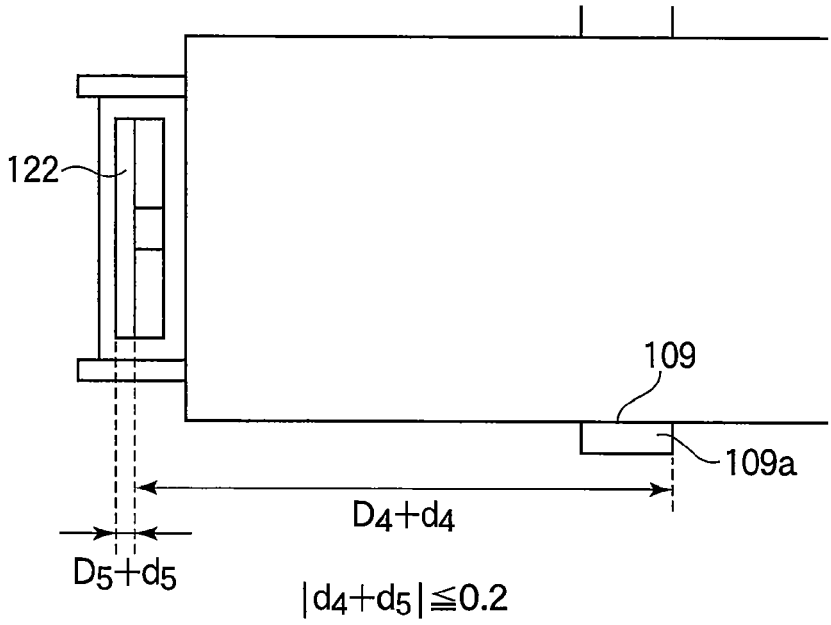
FIG. 16A and 16B illustrate tolerances of respective dimensions.
Figure 16B:
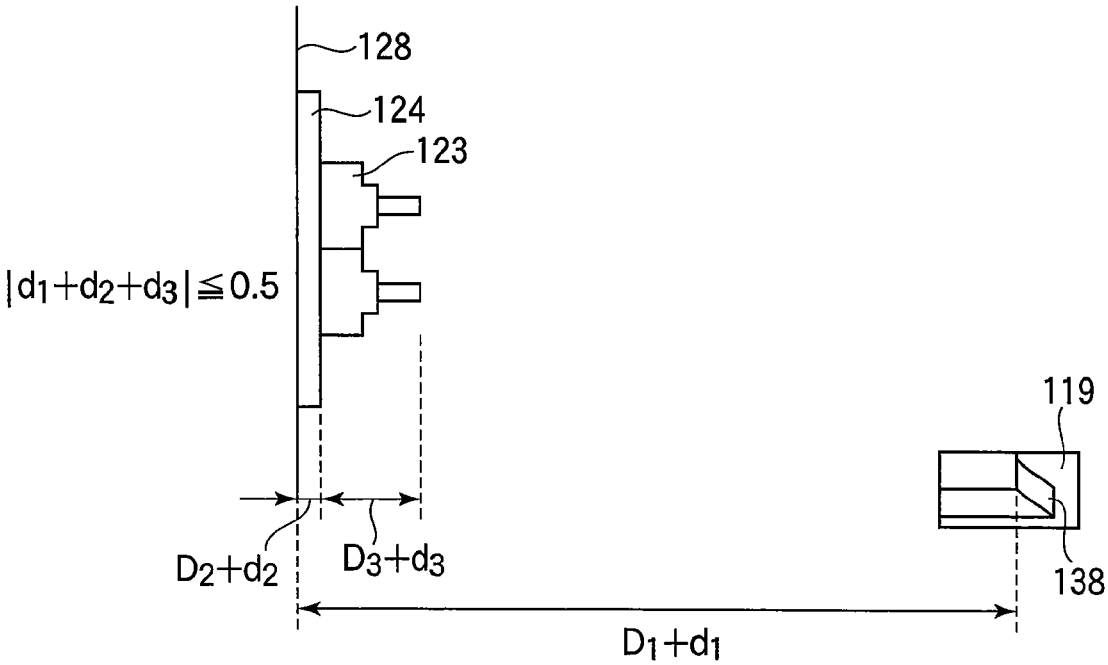

FIGS. 16A and 16B illustrate tolerances of respective dimensions. Referring to FIGS. 16A and 16B the cumulative tolerance of components on the ID unit side includes tolerances d1, d2 and d3. The tolerance d1 applies to the distance from the wall surface 138 of the receiving portion 119 to the surface of the wall 128 that supports the circuit board 124. The tolerance d2 applies to the thickness of the circuit board 124. The tolerance d3 applies to the distance from the surface of the circuit board 124 to the tip of the connector 123. In the present embodiment, the sum of the tolerances d1, d2 and d3 is within ±0.3 mm.

The cumulative tolerance of components on the toner cartridge side includes tolerances d4 and d5. The tolerance d4 applies to the distance from the engagement surface 109*a* of projection 109 to the surface of the circuit board 122 on which the memory element 120 is mounted. The tolerance d5 applies to the thickness of the circuit board 122. Because the projection 109 is formed on the outer surface of the toner cartridge 18 in the vicinity of the longitudinal end portion of the toner cartridge 18, the distance D4 from the engagement surface 109*a* of the projection 109 to the surface of the circuit board 122 may be shortened. For example, if the dimension D4 is 30 mm, then the tolerance d4 may be ±0.1 mm. For example, if the tolerance d5 of the thickness of the circuit board 122 is ±0.1 mm, the sum of the tolerances d4 and d5 is ±0.2 mm. Thus, the aforementioned cumulative tolerance of structural components in the range of ±0.5 mm may be achieved.

From a point of view of normalized distribution of dimensional variations of the respective structural elements, the cumulative errors of most of the manufactured apparatuses may be in the range much smaller than ±0.5 mm.

The toner cartridge 18 is pushed in the longitudinal direction of the toner cartridge 18, thereby causing the contact pads 121*a* and 121*b* of the toner cartridge 18 to become in contact with the connector pins 123*a* and 123*b*. For a toner cartridge having a dimension to accommodate A4/LETTER size paper, the distance from one end of the toner cartridge to the surface of the circuit board 122 is approximately 250 mm, in which case, it is very difficult to manufacture the toner cartridge 18 with an accuracy of ±0.1 mm.

As described above, upon attachment of the toner cartridge 18 to the ID unit 2, the contact pads 121*a* and 121*b* of the toner cartridge 18 is electrically connected to the connector pins 123*a* and 123*b* of the connector 123 of the ID unit 2 and to the contacts 125*a* and 125*b* (FIG. 9) of the ID unit 2 through the circuit board 124 and wires (not shown). When the ID unit 2 with the toner cartridge 18 attached to it has been attached to the image forming apparatus 1, the memory element 120 mounted on the toner cartridge 18 is electrically connected to the controller 30 of the image forming apparatus 1 via the connector 150 and contact 125. Of course, when the ID unit 2 is first attached to the image forming apparatus 1 and the toner cartridge 18 is then attached to the ID unit 2, the memory element 120 may still be electrically connected to the controller 30 of the image forming apparatus 1. The aforementioned construction allows the controller 30 to read the information on the toner from the memory element 120. Thus, when the information on the toner cannot be read, for example, due to the fact that the toner cartridge 18 is not attached to the ID unit 2 or the memory element 120 is not mounted to the toner cartridge 18, the controller 30 determines that the toner cartridge 18 is not attached or that the attached toner cartridge is not accepted. Then, the controller 30 displays a message, for example, "TONER CARTRIDGE NOT ATTACHED" or "TONER CARTRIDGE NOT ACCEPTED" on an LCD of the image forming apparatus 1.

The construction of the first embodiment minimizes the variations in contact pressure between the contact pads 121*a* and 121*b* and the connector pins 123*a* and 123*b*, thereby preventing the poor contact or damage to the contacts due to excessive pressure force. This provides reliable electrical continuity.

When the toner cartridge 18 is attached to the ID unit 2, a relatively large force is required to compress the sealing member 127, a much larger force than the force required for ensuring electrical continuity between the contact pads 121*a* and 121*b* and the connector pins 123*a* and 123*b*. The toner cartridge 18 is pushed against the ID unit 2 to compress the sealing member 127 in one direction while the toner cartridge 18 is pushed against the connector 123 of the ID unit 2 in the other direction. This eliminates the need for applying a force more than necessary for ensuring desired electrical continuity between the contact pads 121*a* and 121*b* and the connector pins 123*a* and 123*b*. This construction prevents not only scratches and damage to the contact pads 121*a* and 121*b* when the toner cartridge 18 is attached to the ID unit 2, but also the poor contact due to the fact that the pressure force decreases with time due to deformation resulting from creep of the structural members. The construction lends itself to recycling of the toner cartridge 18.

Second Embodiment

Figure 17:
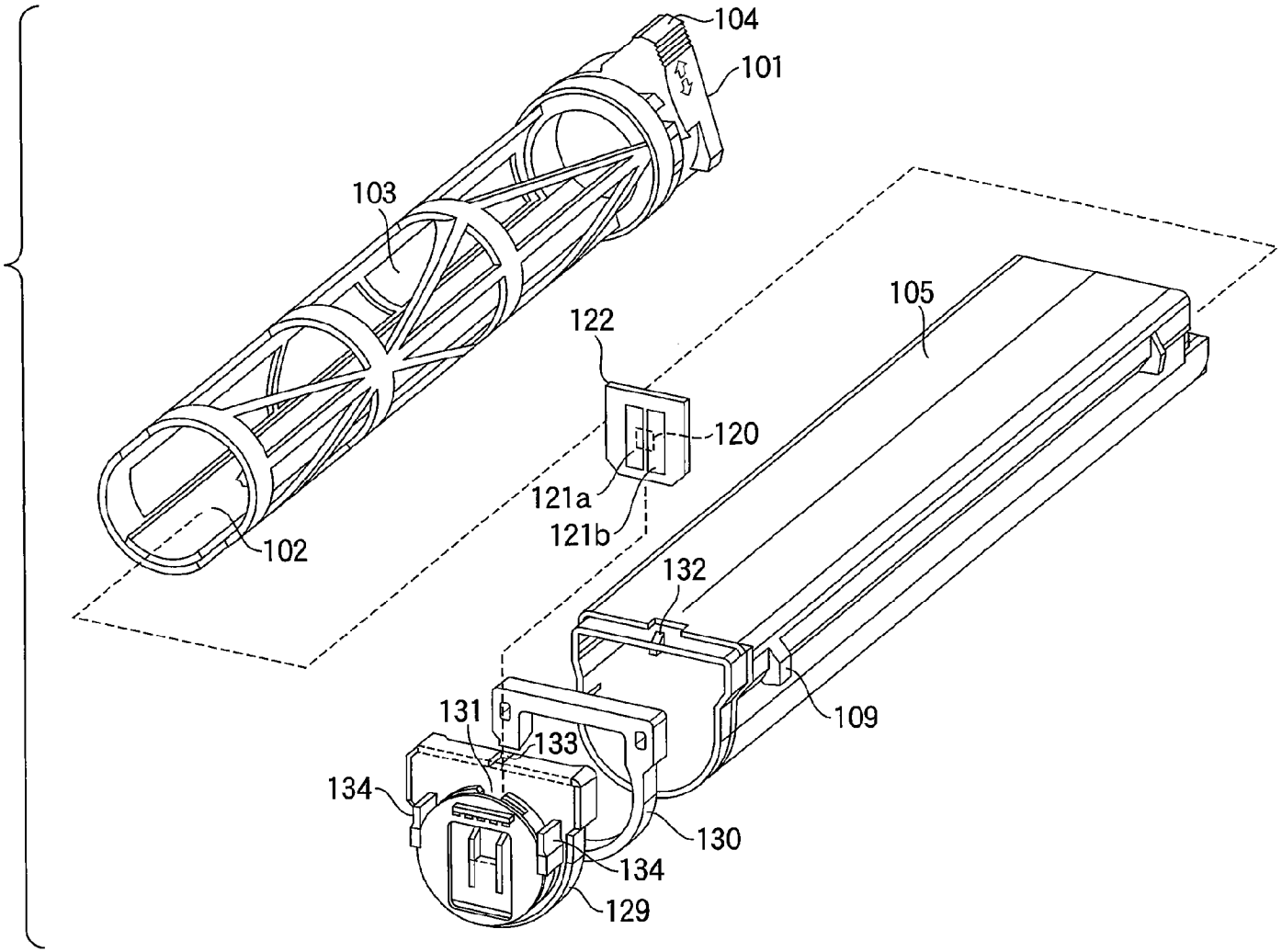
FIG. 17 is an exploded perspective view of a toner cartridge.
Figure 18:
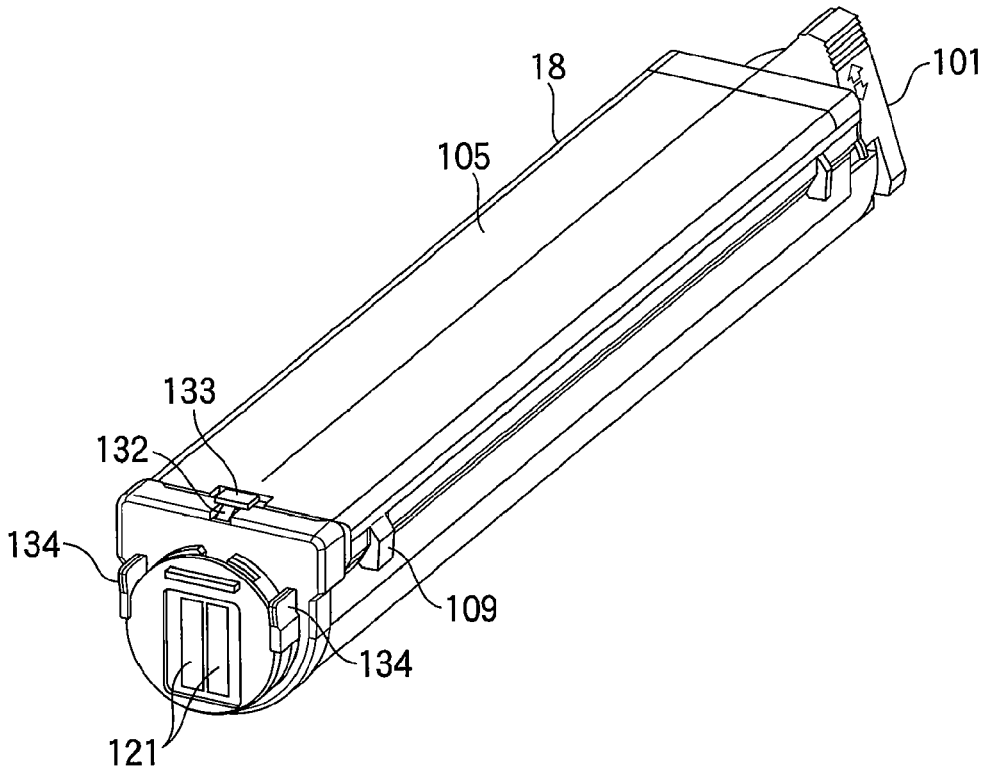
FIG. 18 is a perspective view after the toner cartridge has been assembled.
Figure 19A:
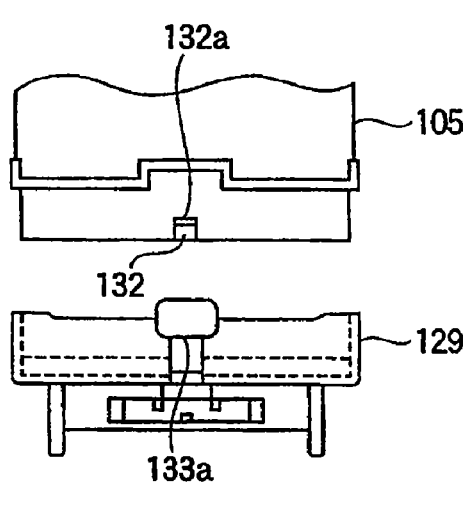
FIGS. 19A-19C illustrates the outer cylinder and the side lid before the side lid is attached to the outer cylinder, FIG. 19A being a top view, FIG. 19B being a front view, and FIG. 19C being a bottom view.
Figure 19B:
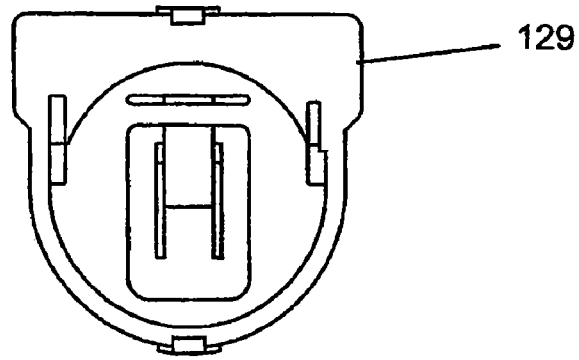
Figure 19C:
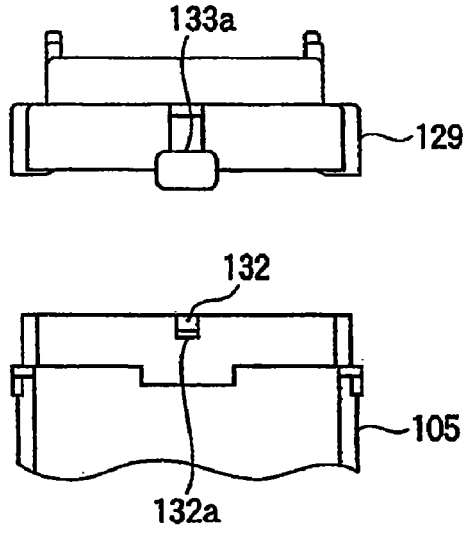

FIG. 17 is an exploded perspective view of a toner cartridge 18. FIG. 18 is a perspective view after the toner cartridge 18 has been assembled. FIGS. 19A-19C illustrates an outer cylinder and a side lid before the side lid is attached to the outer cylinder, FIG. 19A being a top view, FIG. 19B being a front view, and FIG. 19C being a bottom view.

The toner cartridge of the second embodiment differs from the toner cartridge of the first embodiment in that a resilient sealing member 130 formed of a sponge material (e.g., foamed urethane) is sandwiched between an outer cylinder 105 and a side lid 129. A second end that faces the first end of the side lid 129 is not a part of the side lid 106 but is in one piece with the outer cylinder 105. Just as in the outer cylinder 105, the side lid 129 is molded from ABS resin.

The side lid 129 includes a pocket 131 and a projection 134. The pocket 131 receives a circuit board 122. The projection 134 prevents the uplift of the toner cartridge 18 when the toner cartridge 18 is attached to an ID unit 2. A hook 133A is formed on an upper portion and a hook 133B is formed on a lower portion of the side lid 129. The hooks 133A and 133B are used to attach the side lid 129 to the outer cylinder 105.

Figure 20A:
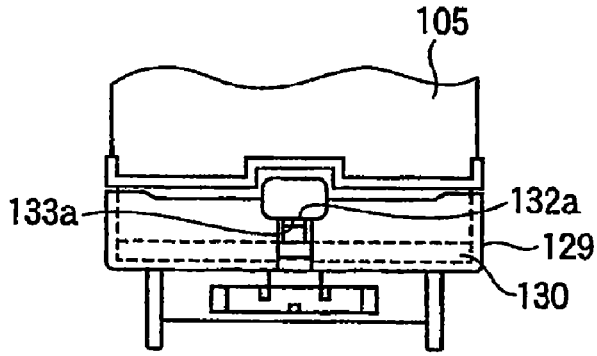
FIGS. 20A-20C illustrates the outer cylinder and the side lid after the side lid has been attached to the outer cylinder, FIG. 20A being a top view, FIG. 20B being a front view, and FIG. 20C being a bottom view.
Figure 20B:
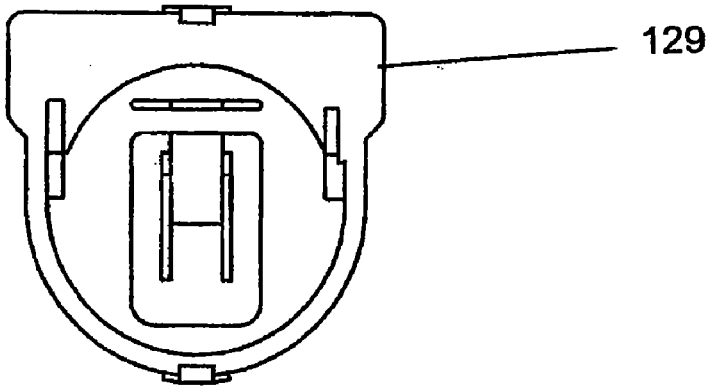
Figure 20C:
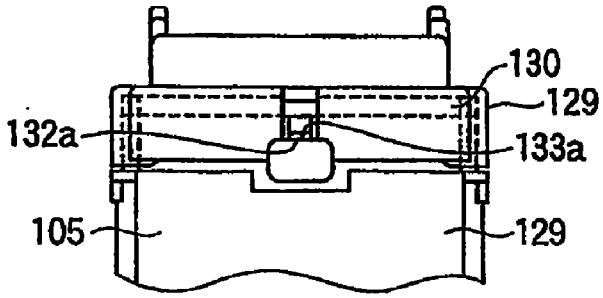

FIG. 19 illustrates the outer cylinder 105 and the side lid 129 before the side lid 129 is attached to the outer cylinder 105. FIGS. 20A-20C illustrate the outer cylinder 105 and the side lid 129 after the side lid 129 has been attached to the outer cylinder 105. FIG. 20A is a top view. FIG. 20B is a front view. FIG. 20C is a bottom view. The hooks 133A and 133B formed on the side lid 129 fit to the projections 132 formed on the outer cylinder 105, thereby firmly fixing the side lid 129 to the outer cylinder 105. A sealing member 130 is sandwiched between the side lid 129 and the outer cylinder 105. The sealing member 130 is resilient such that when the side lid 129 is attached to the outer cylinder 105, the sealing member 130 is compressed by a predetermined amount. Once the side lid 129 has been attached to the outer cylinder 105, the side lid 129 fits to the projection 132 such that the surfaces 133*a* of the hooks 133 engages the surface 132*a* of the projection 132.

When the toner cartridge 18 is attached to the ID unit 2, contact pads 121*a* and 121*b* push the connector pins 123*a* and 123*b* and therefore receives an opposing force. Referring to FIG. 20, a gap L is provided between the outer cylinder 105 and the side lid 129 such that when the contact pads 121*a* and 121*b* pushes the connector pins 123*a* and 123*b*, the side lid 129 moves while compressing the sealing member 130. Gaps are also provided between the projections 132 and the hooks 133A and 133B such that the side lid 129 is allowed to move back in the direction of the opposing force.

The configuration of the ID unit 2 is the same as that of the ID unit of the first embodiment, and therefore the toner cartridge 18 is attached to the ID unit 2 in the same manner as the first embodiment. However, the difference between two distances may be selected to be large than that of the first embodiment: the distance between an engagement surface

109*a* of the projection 109 of the toner cartridge 18 and the surface of the contact 121, and the distance between the wall surface 138 of the receiving portion 119 of the ID unit 2 and the tips of the connector pins 123*a* and 123*b*.

Figure 21:
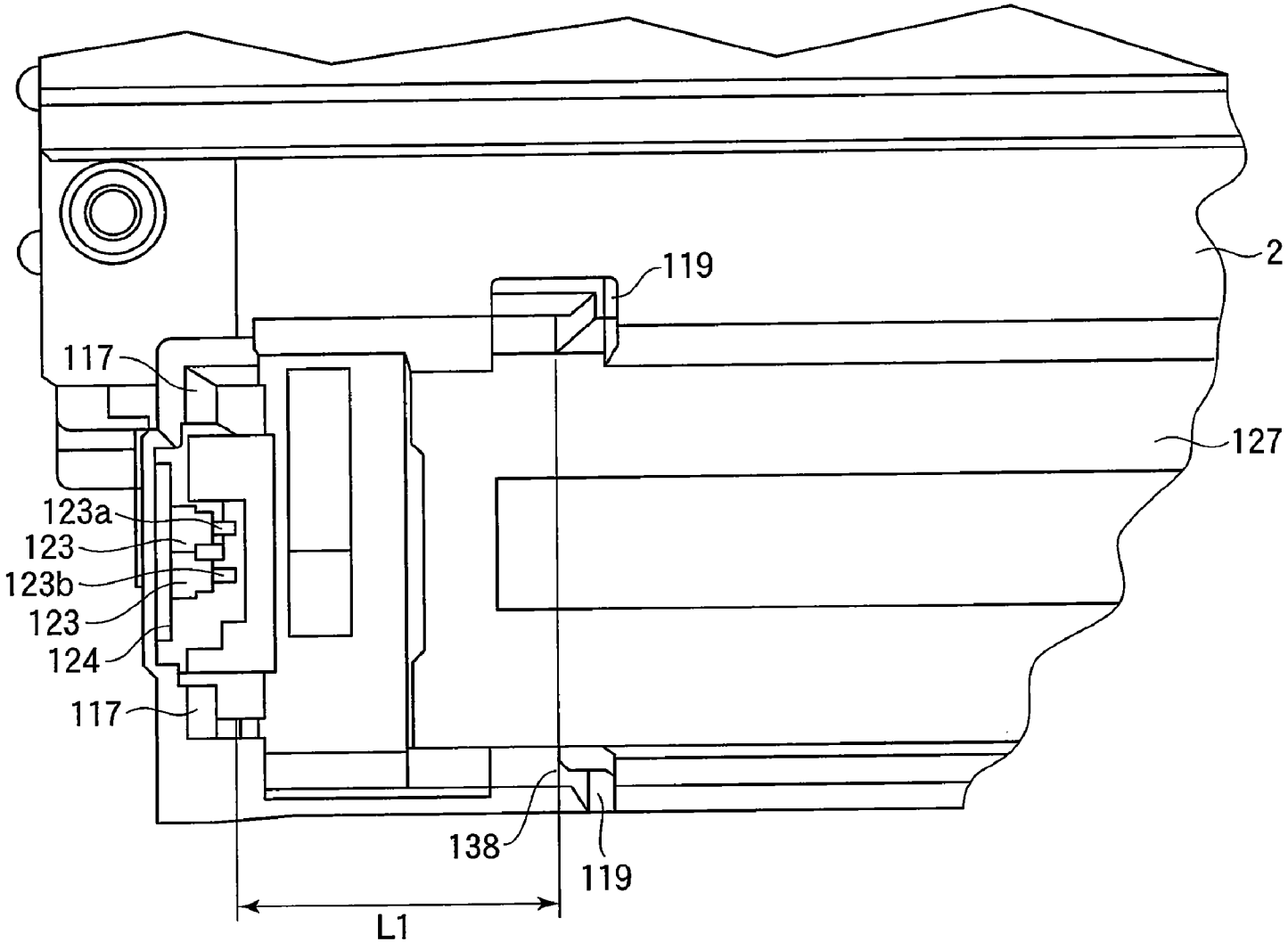
FIG. 21 is a partial top view illustrating the toner cartridge before it is attached to the ID unit.

FIG. 21 is a partial top view illustrating the toner cartridge 18 before it is attached to the ID unit 2.

Figure 22:
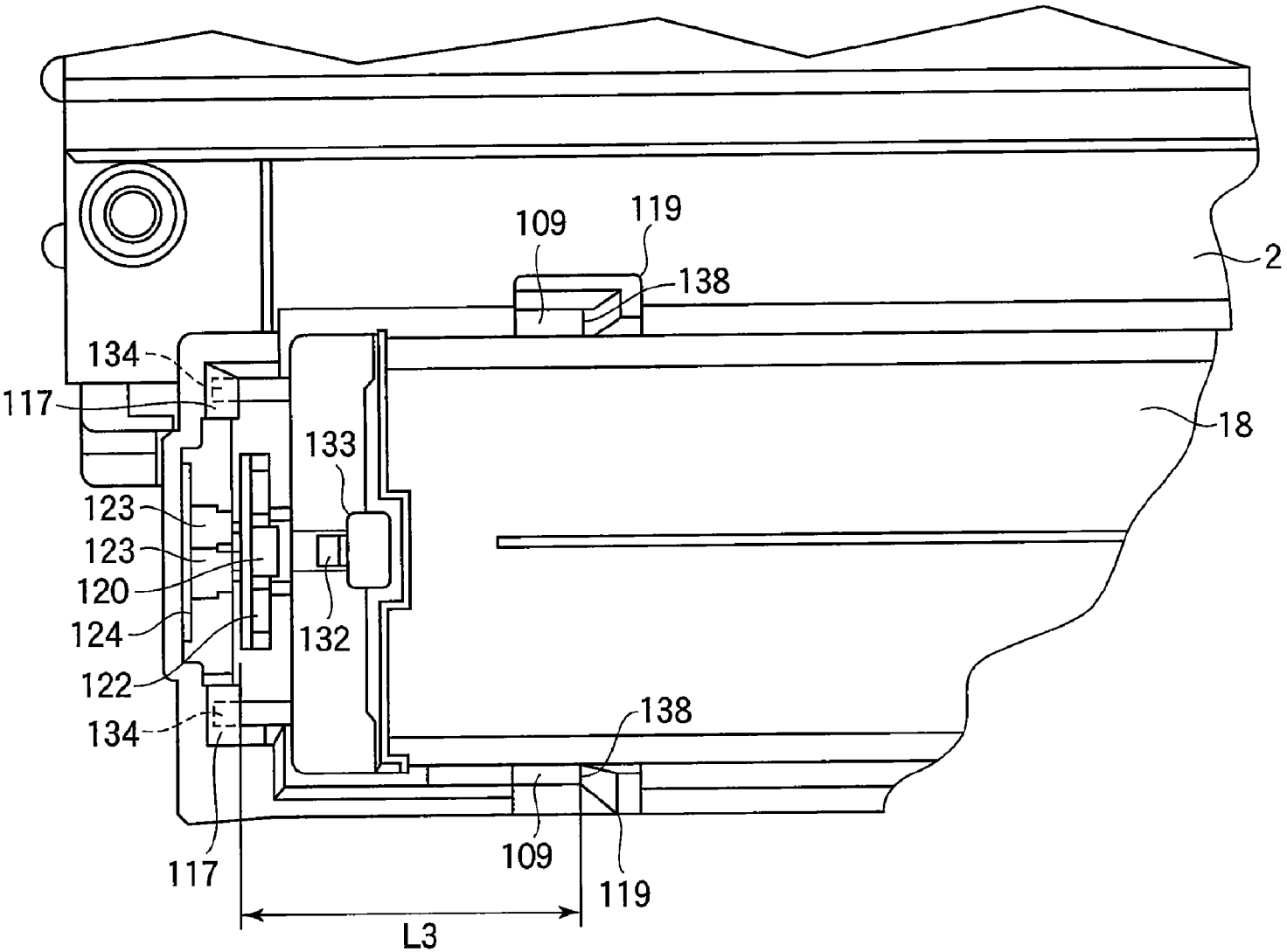
FIG. 22 is a partial top view illustrating the toner cartridge after it is attached to the ID unit.

FIG. 22 is a partial top view illustrating the toner cartridge 18 after it is attached to the ID unit 2.

Referring to FIGS. 21 and 22, the toner cartridge 18 is inserted into the ID unit 2 from above pushing the connector 123 obliquely in such a way that the projection 134 of the toner cartridge 18 fits the projection 117 of the ID unit 2 and the projection 109 of the toner cartridge 18 fits into the receiving portion 119 of the ID unit 2. Then, a groove 136 formed in a lever 104 of the toner cartridge 18 (FIGS. 13-15) receives a projection 135 of the ID unit 2. Then, the user rotates the lever 104, so that the toner cartridge 18 is attached to the ID unit 2 while also causing the sealing member 127 around the toner receiving opening to be compressed to a certain level.

A distance L3 is a distance between the contact pad 121*a* (121*b*) and the engagement surface 109*a* of the projection 109 of the toner cartridge 18. The distance L3 is selected such that when the contact pads 121*a* and 121*b* push the connector pins 123*a* and 123*b*, the side lid 129 displaces while compressing the sealing member 130. Thus, the distance L3 is selected to be larger than the distance L2 of the first embodiment.

Assume that the spring constant of the sealing member 130 is the same as the sum of the spring constants of four connector pins 123*a* and 123*b*, and a minimum amount of deformation is 0.5 mm required for ensuring reliable electrical continuity between the connector pins 123*a* and 123*b* and the contact pads 121*a* and 121*b*. In order to ensure the minimum amount of deformation of 0.5 mm, the difference between the distance L3 and the distance L1 should be 1 mm, the distance L1 being a distance between a wall surface 138 of the receiving portion 119 of the ID unit 2 and the tip of the connector pins 123*a* and 123*b*. Thus, if the effective stroke of the connector pins 123*a* and 123*b* is to be in the range of 0.5 mm to 1.5 mm (i.e., 1±0.5 mm), the center value of the difference between L1 and L3 should be 2 mm and the cumulative tolerance of the structural components is ±1 mm. In other words, the tolerance of the difference between L1 and L3 in the second embodiment may be ±1 mm while the tolerance of the difference between L1 and L3 in the first embodiment is ±0.5 mm.

The second embodiment differs from the first embodiment only in the cumulative tolerance of the structural elements of the toner cartridge 18. Specifically, the cumulative tolerance of the first embodiment includes d4 for the distance from the engagement surface 109*a* of the projection 109 to the surface of the circuit board 122, and d5 for the thickness of the circuit board 122. In contrast, the cumulative tolerance of the second embodiment is a sum of three tolerances: the tolerance for the distance between the engagement surface 109*a* of the end surface 132*a* of the hook 133 and end surface 132*a* of the projection 132, the tolerance for the distance between the end surface 133*a* of the hook 133 and the surface of the circuit board 122, and the tolerance for the thickness of the circuit board 122. The number of tolerances of the second embodiment is three while that of the first embodiment is two. However, the difference in the cumulative tolerances in within ±0.1 mm. This implies that great improvement may be achieved only at the expense of one larger number of tolerances in the second embodiment than in the first embodiment.

Upon attaching the toner cartridge 18 to the ID unit 2, the contact pads 121*a* and 121*b* of the toner cartridge 18 is connected to the connector 123 of the ID unit 2, and is further connected to the contacts 125*a* and 125*b* of the ID unit 2 (FIG. 9) through the circuit board 124 and wires (not shown). Then, upon attaching the ID unit 2 to the image forming apparatus 1, electrical connection is made between the connector 150 of the image forming apparatus 1 and the contacts 125*a* and 125*b* of the ID unit 2, thereby allowing the controller 30 of the image forming apparatus 1 to read the information from the memory element 120 of the toner cartridge 18. The aforementioned construction allows the controller 30 to read the information on the toner from the memory element 120. Thus, when the information on the toner cannot be read, for example, due to the fact that the toner cartridge 18 is not attached to the ID unit 2 or the memory element 120 is not mounted to the toner cartridge 18, the controller 30 determines that the toner cartridge 18 is not attached or that the attached toner cartridge is not accepted. Then, the controller 30 displays a message, for example, "TONER CARTRIDGE NOT ATTACHED" or "TONER CARTRIDGE NOT ACCEPTED" on an LCD of the image forming apparatus 1.

In the second embodiment, the outer cylinder 105 having the projection 109 and the side lid 129 having the contact 121 are manufactured separately. The side lid 129 is assembled to the outer cylinder 105 with the sealing member 130 sandwiched between them. Larger dimension tolerances still ensure necessary pressing force acting between the contact 121 and the connector 123, providing reliable electrical continuity.

Third Embodiment

The first embodiment or the second embodiment may take some time before the toner cartridge 18 is attached properly, if the receiving portion 119 (FIG. 8) of the ID unit 2 interferes with the projection 109 of the toner cartridge 18 or the projection 117 of the ID unit 2 interferes with the projection 118 (FIG. 4) or the projection 134 (FIG. 17) of the toner cartridge 18.

Figure 23:
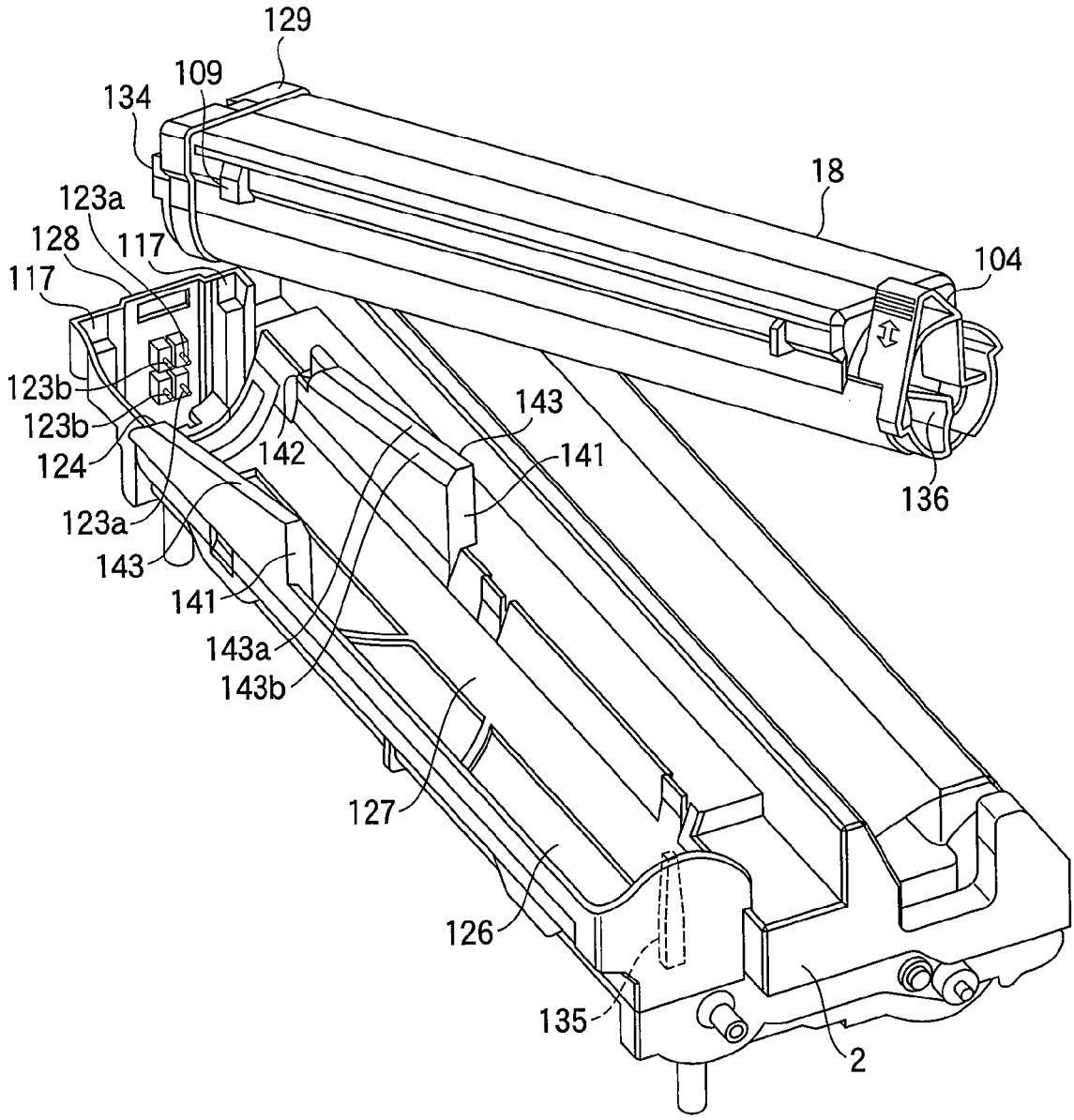
FIG. 23 illustrates a third embodiment.

FIG. 23 illustrates a third embodiment. An ID unit 2 of the third embodiment includes projections 141 that engage projections 109 of the toner cartridge 18. The projection 141 has a shape similar to the receiving portion 119 of the ID unit 2 of the first or second embodiment, extending toward a longitudinally central portion of the ID unit 2. The projections 141 have a height increasing nearer the longitudinally central portion. The projections 141 have guides 143 having a top surface 143*a* and an inclined surface 143*b* contiguous to the top surface 143*a*. When the toner cartridge 18 is inserted into the ID unit 2 from above, the guides 143 abut the projections 109 of the toner cartridge 18 to guide the projections 109 toward stepped portions 142 of the ID unit 2. The toner cartridge in FIG. 23 is the same as that of the first embodiment.

Referring to FIG. 23, the toner cartridge 18 is attached to the ID unit 2 as follows: The toner cartridge 18 is positioned with respect to the ID unit 2 such that the projections 109 of the toner cartridge 18 abut the guides 143 of the projections 141 of the ID unit 2. Because the guides 143 are inclined toward the stepped portions 142, the projections 109 may be guided smoothly toward the stepped portions 142.

At this moment, the toner cartridge 18 is inclined, and the projections 134 of the toner cartridge 18 properly enter under the projections 117 of the ID unit 2. After the projections 134 of the toner cartridge 18 fit the projection 117 of the ID unit 2 and projections 109 of the toner cartridge 18 engage the stepped portions 142 of the projections 141 of the ID unit 2, the operator causes a projection 135 to fit into the groove 136 formed in the lever 104. Thus, the toner cartridge 18 is attached into the ID unit 2 while at the same time causing the sealing member 127, glued to surround the toner receiving opening 126 formed in the ID unit 2, to be compressed.

Then, upon attaching the ID unit 2 to which the toner cartridge 18 has been attached to the image forming apparatus 1, electrical connection is made between the connector 150 of the image forming apparatus 1 and the contacts 125*a* and 125*b* of the ID unit 2, thereby allowing the controller 30 of the image forming apparatus 1 to read the information from the memory element 120 of the toner cartridge 18. Of course, the ID unit 2 may first be attached to the image forming apparatus 1 and then the toner cartridge 18 may be attached to the ID unit 2, the memory element 120 still being electrically connected to the controller 30 of the image forming apparatus 1.

Thus, when the information on the toner cannot be read, for example, due to the fact that the toner cartridge 18 has not been attached to the ID unit 2 yet or the memory element 120 has not been mounted to the toner cartridge 18, the controller 30 determines that the toner cartridge 18 has not been attached or that the attached toner cartridge is not accepted. Then, the controller 30 displays a message, for example, "TONER CARTRIDGE NOT ATTACHED" or "TONER CARTRIDGE NOT ACCEPTED" on an LCD of the image forming apparatus 1.

As described above, the provision of the projections 141 on the ID unit 2 and the guides 134 on the toner cartridge 18 improves mounting efficiency of the toner cartridge 18 onto the ID unit 2.

The structure of the first and second embodiments may be applicable to toner cartridges and ID units used in printers, facsimile machines, copying machines and multifunction apparatuses of these apparatuses. The structure may also be applicable to a waste toner collecting system that collects waste toner resulting from cleaning of a photoconductive drum, an ID unit, and an image forming apparatus that incorporates a waste toner collecting system. The structure may still be applicable to a toner cartridge and ID unit in which a waste toner conveyor belt delivers waste toner to a waste toner chamber.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A toner cartridge for being attached to a toner cartridge holder, comprising:

a body that extends in a longitudinal direction, said body including a first longitudinal end portion and a second longitudinal end portion;

a memory element;

a first electrical terminal disposed on the first longitudinal end portion, said first electrical terminal being electrically connected to said memory element;

an engagement portion formed on an outer surface of said body, the engagement portion being spaced from the first longitudinal end portion and being closer to the first longitudinal end portion than a longitudinally middle portion of said body;

wherein the toner cartridge is configured such that when the toner cartridge is attached to the toner cartridge holder with the body extending longitudinally in a horizontal direction, the second longitudinal end portion engages the toner cartridge holder and said engagement portion engages the toner cartridge holder such that the first longitudinal end portion is pressed in the horizontal direction against the toner cartridge holder to be held in position.

2. The toner cartridge according to claim 1, wherein the toner cartridge includes a lid fitted to the first longitudinal end portion with a resilient member sandwiched between the lid and said first longitudinal end portion.

3. The toner cartridge according to claim 2, wherein the resilient member seals a gap between the lid and said first longitudinal end portion.

4. The toner cartridge according to claim 1, wherein the toner cartridge includes a circuit board on which said memory element and said first electrical terminal are mounted, the circuit board being removably attached to said first longitudinal end portion.

5. A toner cartridge holder including the toner cartridge according to claim 1, comprising:

a second electrical terminal electrically connected to said first electrical terminal when the toner cartridge is attached to the toner cartridge holder, wherein the toner cartridge holder is configured so that information is communicated through said first and second electrical terminals between said memory element and the toner cartridge holder;

and wherein the toner cartridge holder further comprises a receiving member that receives said engagement portion of the toner cartridge when the toner cartridge is attached into the toner cartridge holder, said receiving member being configured to engage said engagement portion such that the first longitudinal end portion is pressed against the toner cartridge holder to be held in position.

6. The toner cartridge holder according to claim 5, wherein said receiving member includes a guide surface that guides said engagement portion toward said second electrical terminal.

7. An image forming apparatus including the toner cartridge holder according to claim 5.

8. A toner cartridge comprising:

a body that extends in a longitudinal direction and which includes a first longitudinal end portion and a second longitudinal end portion;

a memory element;

a first electrical terminal disposed on the first longitudinal end portion, said first electrical terminal being electrically connected to said memory element; and a projection formed on an outer surface of said body, the projection being spaced from the first longitudinal end portion and being closer to the first longitudinal end portion than a longitudinally middle portion of said body, wherein the toner cartridge is configured such that when the toner cartridge is inserted into the toner cartridge holder, the projection engages a receiving portion of the toner cartridge holder and slides on an inclined wall of the receiving portion so that the first longitudinal end portion is pressed against an end of the toner cartridge holder, and when the toner cartridge is completely received in the toner cartridge holder, the first end portion opposes a connector and the second end portion opposes an end wall of the toner cartridge holder positioned away from the connector, and wherein the connector comprises connector pins which are deformed by the toner cartridge insertion into the toner cartridge holder by a deformation distance, the deformation distance being a difference between a first and a second distance, the first distance being a distance between a wall surface of the receiving portion and end portions of the undeformed connector pins, and the second distance being a distance between an engagement surface of the projection and the first electrical terminal.

9. The toner cartridge according to claim 8, wherein the toner cartridge includes a lid fitted to the first longitudinal end portion with a resilient member sandwiched between the lid and the first longitudinal end portion.

10. The toner cartridge according to claim 9, wherein the resilient member seals a gap between the lid and the first longitudinal end portion.

11. The toner cartridge according to claim 8, wherein the toner cartridge includes a circuit board on which said memory element and said first electrical terminal are mounted, the circuit board being removably attached to the first longitudinal end portion.

12. A toner cartridge holder comprising the toner cartridge according to claim 1, wherein the engagement member comprises a projection, the toner cartridge holder comprising:

a second electrical terminal electrically connected to said first electrical terminal when the toner cartridge is attached to the toner cartridge holder, wherein the toner cartridge holder is configured so that information is communicated through said first and second electrical terminals between said memory element and the toner cartridge holder; and a receiving member that receives said projection of the toner cartridge when the toner cartridge is attached to the toner cartridge holder, wherein said receiving member engages said projection such that the first longitudinal end portion is pressed against the toner cartridge holder to be held in position.

13. The toner cartridge holder according to claim 12, wherein said receiving member includes a guide surface that guides said projection toward said second electrical terminal.

14. The toner cartridge according to claim 8, wherein the projection is configured to engage a toner cartridge holder in a position proximate to the first longitudinal end portion.

15. A toner cartridge for being attached to a toner cartridge holder, comprising:

a body that extends in a longitudinal direction, said body including a first longitudinal end portion and a second longitudinal end portion;

a memory element;

a first electrical terminal disposed on the first longitudinal end portion, said first electrical terminal being electrically connected to said memory element; and an engagement portion formed on an outer surface of said body, the engagement portion being spaced from the first longitudinal end portion and being closer to the first longitudinal end portion than a longitudinally middle portion of said body;

wherein the toner cartridge is configured such that when the toner cartridge is attached to the toner cartridge holder, the second longitudinal end portion engages the toner cartridge holder and said engagement portion engages the toner cartridge holder to urge the toner cartridge to move in the longitudinal direction such that the first longitudinal end portion is pressed in the longitudinal direction against the toner cartridge holder to be held in position, wherein the toner cartridge is configured such that when the toner cartridge is inserted into the toner cartridge holder, the engagement portion engages a receiving portion of the toner cartridge holder and slides on an inclined wall of the receiving portion so that the first longitudinal end portion is pressed against an end of the toner cartridge holder, and when the toner cartridge is completely received in the toner cartridge holder, the first longitudinal end portion opposes a connector and the second longitudinal end portion opposes an end wall of the toner cartridge holder positioned away from the connector, and wherein the connector comprises connector pins which are deformed by the toner cartridge insertion into the toner cartridge holder by a deformation distance, the deformation distance being a difference between a first and a second distance, the first distance being a distance between a wall surface of the receiving portion and end portions of the undeformed connector pins, and the second distance being a distance between an engagement surface of the engagement portion and the first electrical terminal.

16. The toner cartridge according to claim 1, wherein the engagement portion is spaced from the first electrical terminal and at least a solid portion of the toner cartridge is interposed between the engagement portion and the first electrical terminal.

17. The toner cartridge according to claim 8, wherein the projection is spaced from the first electrical terminal and at least a solid portion of the toner cartridge is interposed between the projection and the first electrical terminal.

18. The toner cartridge according to claim 15, wherein the engagement portion is spaced from the first electrical terminal and at least a solid portion of the toner cartridge is interposed between the engagement portion and the first electrical terminal.

19. The toner cartridge according to claim 1, wherein the toner cartridge is configured such that when the toner cartridge is inserted into the toner cartridge holder, the engagement portion engages a receiving portion of the toner cartridge holder and slides on an inclined wall of the receiving portion so that the first longitudinal end portion is pressed against an end of the toner cartridge holder, and when the toner cartridge is completely received in the toner cartridge holder, the first end portion opposes a connector and the second end portion opposes an end wall of the toner cartridge holder positioned away from the connector, and wherein the connector comprises connector pins which are deformed by the toner cartridge insertion into the toner cartridge holder by a deformation distance, the deformation distance being a difference between a first and a second distance, the first distance being a distance between a wall surface of the receiving portion and end portions of undeformed connector pins, and the second distance being a distance between an engagement surface of the engagement portion and the first electrical terminal.

20. A toner cartridge for being attached to a toner cartridge holder, comprising:

a body that extends in a longitudinal direction, the body including a first longitudinal end portion and a second longitudinal end portion;

a first electrical terminal disposed on the first longitudinal end portion; and an engagement portion formed on an outer surface of the body, the engagement portion being spaced from the first longitudinal end portion and being closer to the first longitudinal end portion than a longitudinally middle portion of the body;

wherein the toner cartridge is configured such that when the toner cartridge is inserted into the toner cartridge holder, the engagement portion engages a receiving portion of the toner cartridge holder and slides on an inclined wall of the receiving portion so that the first longitudinal end portion is pressed against an end of the toner cartridge holder, and when the toner cartridge is completely received in the toner cartridge holder, the first end portion opposes a connector and the second end portion opposes an end wall of the toner cartridge holder positioned away from the connector, and wherein the connector comprises connector pins which are deformed by the toner cartridge insertion into the toner cartridge holder by a deformation distance, the deformation distance being a difference between a first and a second distance, the first distance being a distance between a wall surface of the receiving portion and end portions of undeformed connector pins, and the second distance being a distance between an engagement surface of the engagement portion and the first electrical terminal.

* * * * *